US006425527B1

(12) United States Patent
Smole

(10) Patent No.: US 6,425,527 B1
(45) Date of Patent: Jul. 30, 2002

(54) TEMPERATURE CONTROL DEVICE FOR SLEEPING

(76) Inventor: Lewis T. Smole, 235 Maylawn Ave., Wadsworth, OH (US) 44281

( * ) Notice: Subject to any disclaimer, the term of this patent is extended or adjusted under 35 U.S.C. 154(b) by 0 days.

(21) Appl. No.: 09/907,030

(22) Filed: Jul. 17, 2001

(51) Int. Cl.[7] ..... F24F 7/00
(52) U.S. Cl. ..... 236/49.3; 5/423
(58) Field of Search ..... 236/49.3; 454/231; 5/423, 421

(56) References Cited

U.S. PATENT DOCUMENTS 3,681,797 A 8/1972 Messner
3,757,366 A 9/1973 Sacher
3,928,876 A 12/1975 Starr
4,534,276 A * 8/1985 Allison ..... 454/231
4,847,933 A 7/1989 Bedford
5,341,650 A * 8/1994 Nagasawa et al. ..... 454/231
5,473,783 A 12/1995 Allen
5,894,615 A 4/1999 Alexander
6,027,464 A 2/2000 Dahlquist
6,131,220 A 10/2000 Morimura
6,171,333 B1 1/2001 Nelson et al.
6,209,335 B1 * 4/2001 Nowaczyk ..... 454/231
6,210,428 B1 * 4/2001 Augustine et al. ..... 5/423

* cited by examiner

*Primary Examiner*—William E. Tapolcai
*Assistant Examiner*—Mohammad M. Ali
(74) *Attorney, Agent, or Firm*—Hahn Loeser & Parks LLP

(57) ABSTRACT

A device for controlling the temperature of a person's sleeping environment. The device comprises a means of drawing a vacuum through an intake hose or pad. The intake hose or pad is positioned under the bed covers. Air is drawn from under the bed covers and expelled into the ambient space of the room. A thermostat or thermister monitors the temperature of the sleeping environment and adjusts the speed of the vacuum means based upon said temperature.

23 Claims, 4 Drawing Sheets

TEMPERATURE CONTROL DEVICE FOR SLEEPING

TECHNICAL FIELD

The present invention relates generally to a device that controls the temperature of a person's sleeping environment. Additionally, this invention provides a method of treating sleep apnea. Specifically, this invention is a device that pulls a suction through a tube, drawing air through a hose from an area in a person's sleeping environment, e.g. between a mattress and blanket. The hose may alternatively be connected to a pad which is placed in the person's sleeping environment, thereby removing warm air from the sleeping environment from beneath the person. A thermostat senses the temperature of the air being drawn through the hose or pad and adjusts the amount of air being drawn from the sleeping environment. When the temperature of a person's sleeping environment is reduced, that person is less likely to suffer from snoring, delayed breathing or other symptoms of sleep apnea.

BACKGROUND OF THE INVENTION

Controlling the temperature of a person's sleeping environment is often a difficult task. If a person uses blankets, body heat causes the sleeping environment to increase in temperature during the night. Without a method to remove the heat from the sleeping environment, a person must remove the blankets periodically during the night, or sleep in a hyper-heated environment. If a person removes the blankets, the heat is dissipated, but the ambient temperature of the room is often below the optimum temperature for sleep comfort, and the person gets cold. When a person does not remove the blankets and sleeps in a hyper-heated environment, he or she develops a higher body temperature and is thus more likely to suffer from sleep apnea.

Sleep apnea is a condition that affects an estimated twelve million people in the United States. The symptoms of sleep apnea manifest during the night while the person is asleep. The most common type of sleep apnea results from an obstruction of the airway of a person. The symptoms include loud snoring and actual lapses in breathing of up to a minute at a time. Sleep apnea can cause irregular heartbeats, depression, high blood pressure, insomnia, daytime drowsiness, and unexplained changes in behavior.

Present treatment options for sleep apnea include ceasing alcohol use, losing weight, and sleeping on a person's side. If those activities do not resolve the problem, a person can wear a special pressurized mask during sleep, or even have surgery to remove the tonsils or extra tissue in the throat. Wearing a mask during sleep may be an uncomfortable and awkward treatment option. Moreover, surgery is an invasive and expensive procedure. The present invention is a non-invasive and more cost effective way to treat sleep apnea.

SUMMARY OF THE INVENTION

It is an object of the present invention to automatically control the temperature of a person's sleeping environment. One example of a person's sleeping environment is the area where a person's torso and/or extremities are located during sleep, (i.e.) between the bottom sheet that covers the mattress and any blankets that cover the person.

A further object of the present invention is to provide a method for treating sleep apnea, by reducing the temperature of a person's sleeping environment. When a sleeping person has a cooler atmosphere and thus, a cooler body temperature, they are able to breathe more freely.

In one embodiment of the present invention, a means for drawing a vacuum through a hose or tube, or cylinder is provided. An end portion of the hose, tube, or cylinder is situated in the person's sleeping environment. The vacuum means draws a light suction from the sleeping environment and expels said warm air into the ambient space of the room. A thermostat monitors the temperature of the air being drawn from the sleeping environment and controls the speed of the vacuum means. When the temperature of the air being drawn from the sleeping environment is higher, the vacuum means draws more suction, and therefore more heated air will be drawn from the sleeping environment. When the temperature of the air being drawn out of the sleeping environment is lower, the output of the vacuum means is lower, and therefore less air will be drawn from of the sleeping environment.

A second embodiment of the present invention comprises a pad that is placed under the person in the sleeping environment. The pad has air-circulatory tubes, channels, or conduits embedded therein that are fluidly connected to the vacuum means, such as by a tube. The pad contains a plurality of holes or openings in the upper surface of the pad, which extend through the circulatory tubing, channels, or conduits, and therefore allow air to be drawn from the sleeping environment, through the openings, and into the tubes, channels, or conduits. The tubes, channels, or conduits are fluidly connected to the vacuum means, and therefore the air is subsequently drawn through the vacuum means and expelled into the ambient space of the room. A thermostat monitors the temperature of the air being drawn from the sleeping environment and adjusts the amount of air drawn by the vacuum means based upon the temperature of air.

DETAILED DESCRIPTION OF THE INVENTION

Figure 1:
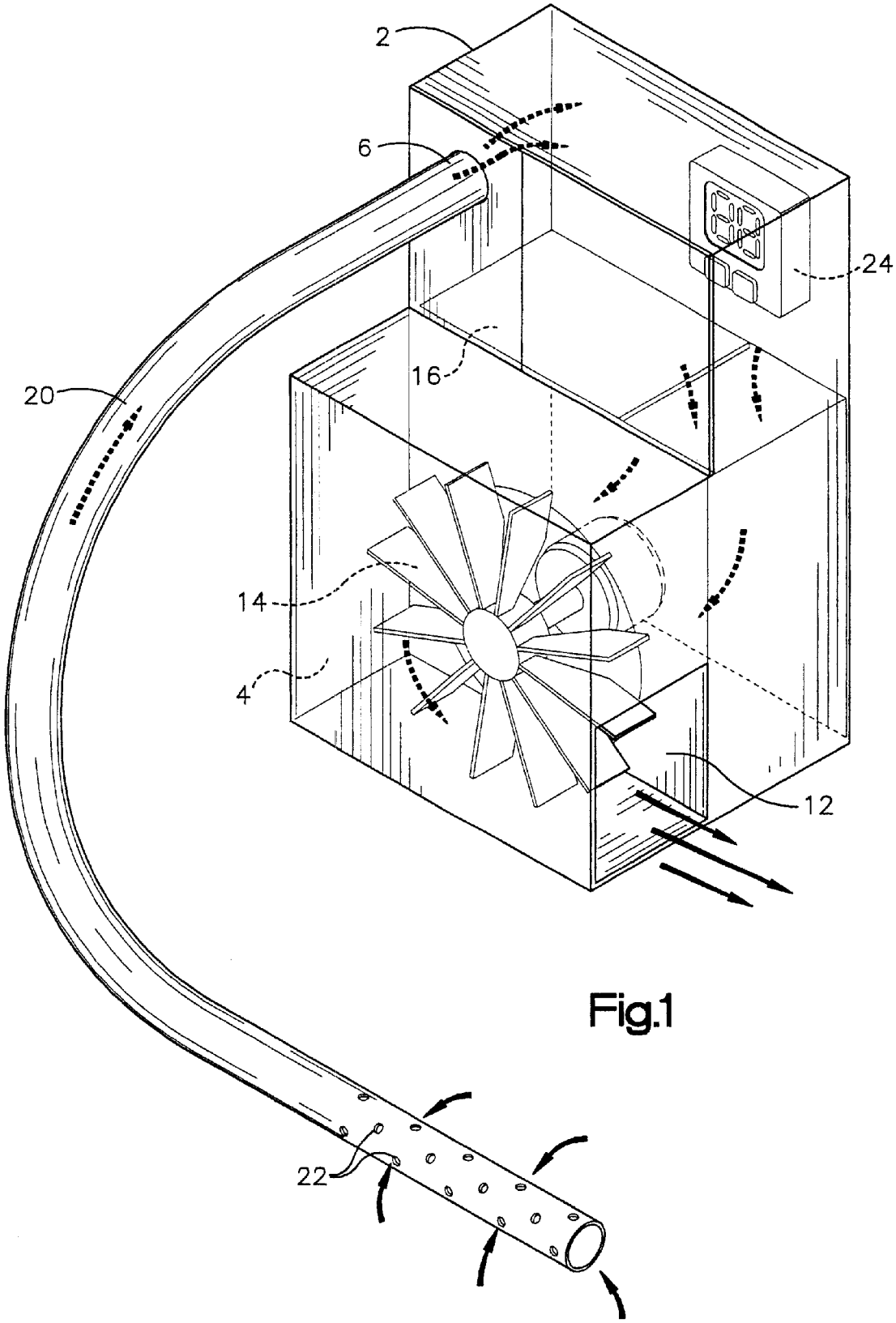
FIG. 1 illustrates a housing and intake tube in accordance with a first embodiment of the present invention.

The present invention will be described herein with reference to the attached figures. It should be understood that although specific embodiments are shown in the drawings and described herein, variations of these embodiments are clearly within the scope of the present invention. Variations on materials, known electrical connections, sizes, shapes or any other components of the device or method described herein may be varied and still be encompassed by the scope of the claims herein.

Figure 2:
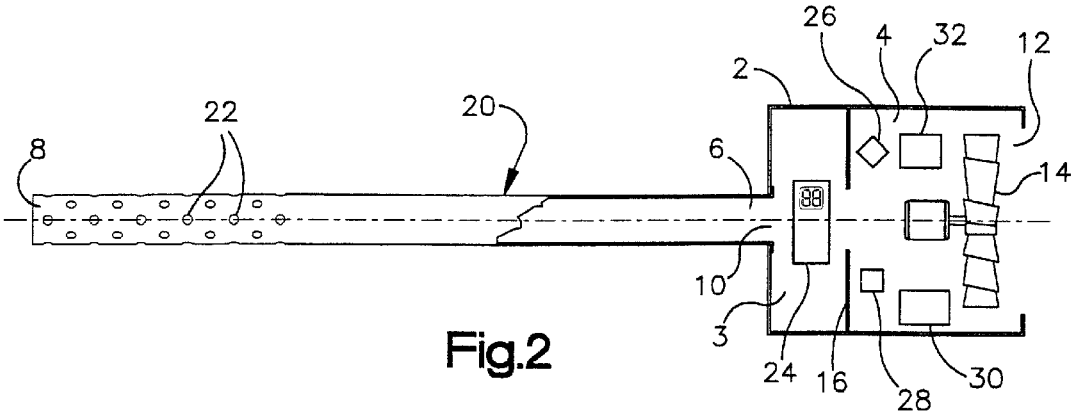
FIG. 2 is a schematic diagram of a vacuum means, thermostat and electrical components in accordance with a first embodiment of the present invention.

Turning now to FIGS. 1 and 2, there is illustrated a device to control a temperature of a person's sleeping environment. The device comprises a housing 2 which includes a means for drawing a vacuum. The housing has an intake port 10 through which air is drawn into the housing from a sleeping environment, and an exhaust port 12 for allowing escape of air drawn through the housing. The housing further includes a means for fluidly connecting said intake port 10 of said housing to a sleeping environment. In a preferred embodiment, the means for fluidly connecting the vacuum means to the sleeping environment is a tube or hose 20. A thermostat 24 is also included to monitor the temperature of the air drawn from the sleeping environment. Based on the temperature reading of the thermostat 24 the amount of air being drawn from said sleeping environment may be adjusted to draw more or less air.

The housing 2 may be made of a variety of materials including wood, plastic, or metals. In a preferred embodiment, a wooden box is preferred to construct the housing as it decreases the transmission of sounds created by the operation of the vacuum means. However, the housing 2 may be made of any materials of sufficient size and shape to house the necessary components of the present invention.

This embodiment of the invention may comprise an electric fan 14 that is located within housing 2 to draw the air through tube 20 from the sleeping environment. In a preferred embodiment, a transformer is capable of controlling the speed of the fan such that the fan can draw varying amounts of air from a person's sleeping environment. In another embodiment, the fan has a motor which is capable of operating at different speeds such that when the temperature reading of the thermostat reaches a predetermined level, the fan speed can increase or decrease to draw more or less air from the sleeping environment. The area of the housing around the fan may be insulated to decrease noise levels coming from the fan. The insulation may be in the form of various fabrics, such as terry cloth or felt, or may be a foam type insulation. Other insulating materials which can cover the inner wails of the housing around the fan so long as the insulation does not obstruct the insertion of the fan into the housing or interfere with the functioning of the fan.

As described above, the housing has two ports, or openings. One of the ports functions as an air intake 10 for the fan. The other port functions as an air exhaust 12 for the fan. A screen, shutter, or other covering may cover the exhaust port 12, so long as exhaust air can be expelled freely.

A hose or tube 20 is attached to the intake port 10 of the housing. The hose or tube 20 is preferably open at both ends. Alternatively the ends of the tube 20 may have a screen or covering which may restrict but not prevent air flow through the hose. The hose 20 is preferably a flexible, plastic tube. The end of the hose that is attached to the intake port 10 is referred to as the proximate end 6 of the hose. The proximate end 6 of the hose can be permanently attached to said intake port 10 or removably attached to said intake port 10. Said hose has an open distal end 8, which is situated within a sleeping environment of a person, and functions as an air intake means for the fan. In a preferred embodiment, the distal end 8 of the hose 20 has a plurality of holes 22 therein. The holes 22 function as supplemental openings for air from the sleeping environment to enter the hose 20. When the system is in its operational mode, warm air will be drawn from the sleeping environment, through the open distal end 8 of the intake hose 20 and the holes 22 into the intake port 10, and out the exhaust port of the vacuum means. In an embodiment of the present invention where there are air intake holes in the tube, the distal end 8 of the tube may be closed.

Air suctioned from the sleeping environment through tube 20 dissipates, which may cause a decrease in the temperature of the air in the tube. The air temperature might also be affected by the ambient temperature of the room where the invention is used. The length and diameter of the tube can assist with decreasing dissipation. In a preferred embodiment, the diameter of the tube is 1¼ inch to minimize a loss of temperature as the air travels through the tube 20. However, tubes with larger and smaller diameters are within the scope of the present invention. Further, the tube 20 may be insulated to resist cooling of the air as it travels through the tube.

A thermostat 24 is electrically connected to the fan. The thermostat 24 is situated within the housing 2. The thermostat 24 monitors the temperature of the air being drawn out of the sleeping environment through the tube 20 and into the housing 2. A transformer is connected to the fan motor. In order to draw light suction continuously, the transformer sends low power to the fan. A speed control may be used to control the speed of the fan motor. When the thermostat senses a change in the temperature of the air being drawn out of the sleeping environment, the thermostat electrically communicates with the fan via a relay to adjust the speed of the fan based upon the temperature of air. When the temperature of the air increases, the speed of the fan increases to draw more warm air from the sleeping environment; when the temperature of the air decreases, the speed of the fan decreases and draws less air from the sleeping environment. This is accomplished by bypassing a transformer which is used to limit the voltage passing through to the fan motor.

The thermostat is adjustable, whereby a person can set predetermined temperatures at which the speed of the fan should increase or decrease. In a preferred embodiment, the thermostat is very sensitive to monitor temperatures over a narrow range. However, a thermostat of any particular sensitivity is not required.

In a preferred embodiment, the housing 2 also has separate chambers for the thermostat 24 and the fan 14. For instance, as shown in FIG. 1, a wall 16 may be placed between where the thermostat 24 is situated in the housing and where the fan 14 is situated in the housing. The wall has a space therein so that the operation of the fan draws air from the sleeping environment. However, the presence of the wall and the distance between the fan and the thermostat substantially prevents heat from the operation of the fan motor from artificially raising the reading of the thermostat. In addition the area of the housing surrounding the thermostat can be insulated with a heat retaining or reflective material to assist with obtaining an accurate measure of the air temperature coming from the sleeping environment. In one embodiment, the area of the housing where the thermostat is located may be lined with a reflective foil material to avoid temperature loss of the air drawn from the sleeping environment.

Figure 3:
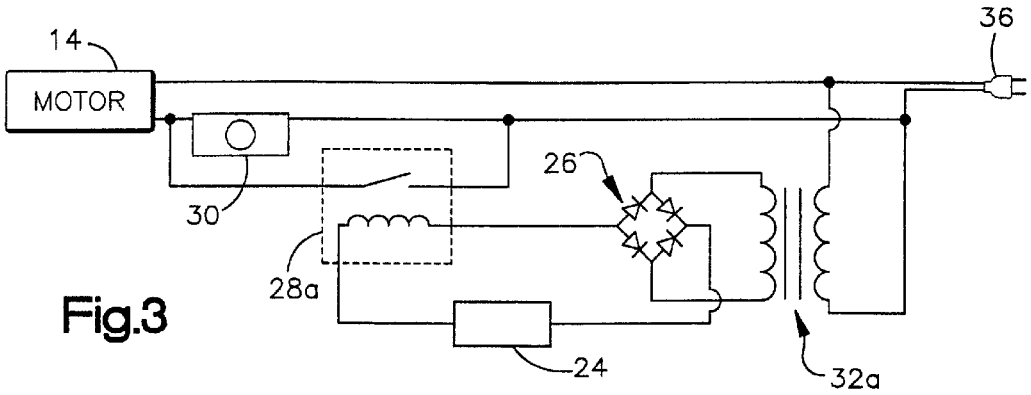
FIG. 3 is a circuit diagram illustrating the operation of one embodiment of the present invention.
Figure 4:
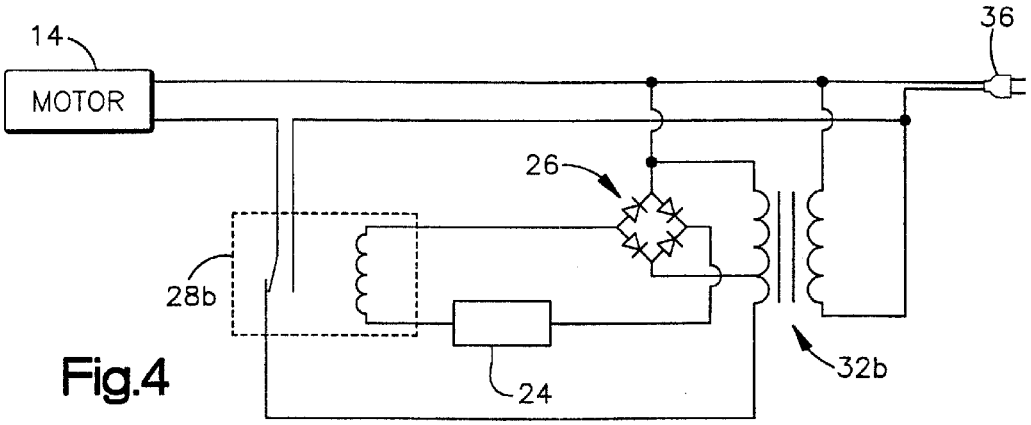
FIG. 4 illustrates an alternative circuit diagram for operation of one embodiment of the present invention.
Figure 5:
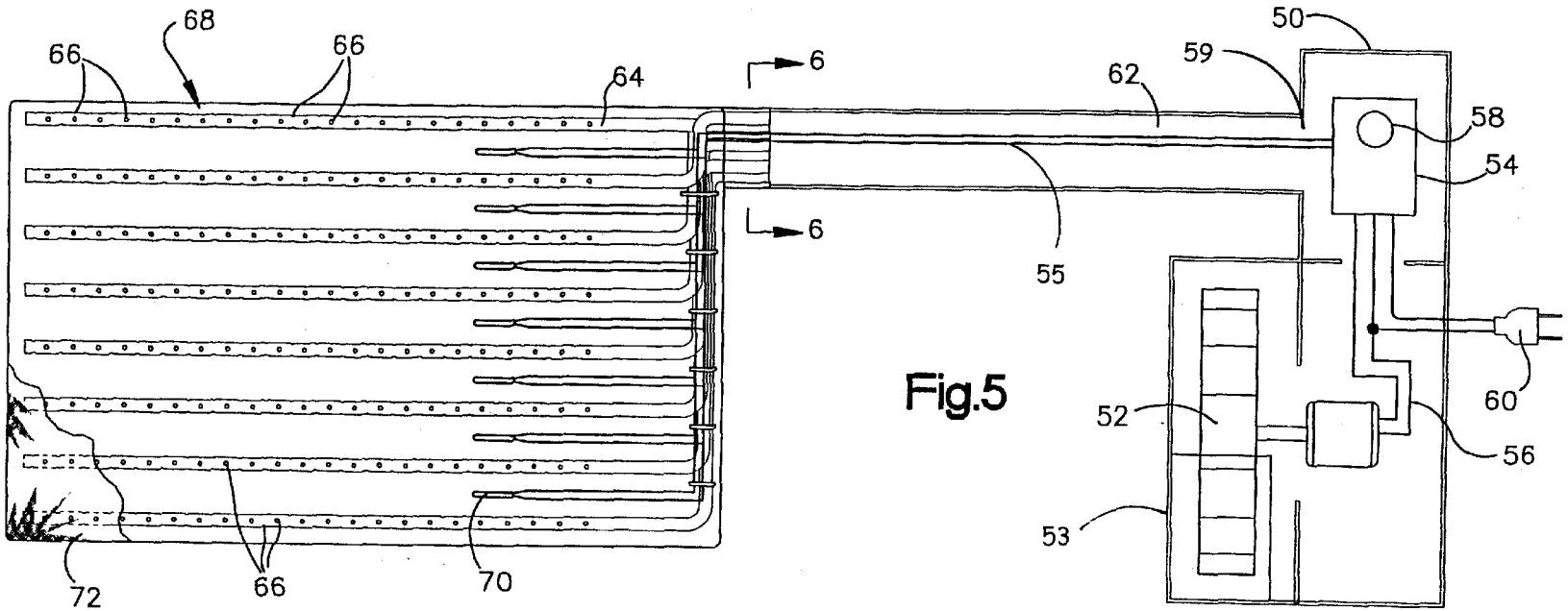
FIG. 5 illustrates an second embodiment of the present invention.

Two potential circuit diagrams for controlling the present invention are shown in FIGS. 3 and 4. In FIG. 3, it is shown that the fan motor 14 is connected to a 110 V outlet 36. The device also has a 24 V transformer. The thermostat is preferably set at a temperature just above the ambient temperature. At these temperatures, the power supplied to the fan passes through a fan speed controller so that the fan draws a light suction for the thermostat to monitor the temperature of the air in the sleeping embodiment. A fan speed control mechanism is included to keep the fan running at a low speed. In this embodiment the fan motor 14 is continuously running at low speed to draw air from the sleeping environment. The air drawn into the housing through the tube passes over or surrounds thermostat 24. When the thermostat senses an air temperature that is at or above a predetermined temperature, the relay switch 28*a* will close causing the thermostat 24 control to bypass the fan speed controller and provided the fan with a full 110 volts. At this temperature, the relay 28*a* switch will complete the circuit and switch the fan speed control 30 to 110 V or full speed to draw more air from the sleeping environment. When the thermostat 24*a* senses a temperature that is lower than a predetermined temperature, the relay switch 28*a* will open and the fan motor will switch back to the lower speed. It is contemplated by the present invention that the fan motor may also have various speeds which can be switched to at various temperature gradients.

FIG. 4 shows an alternative circuit for the device of the present invention. In this circuit, when relay switch 28*b* is closed a 24 V, 34 V or another type of transformer is used to turn the fan motor at a low speed. The thermostat 24 monitors the temperature of air drawn from the sleeping temperature. When the temperature reaches a predetermined level, the thermostat communicates with the fan motor 14 by closing relay switch 28*b* to adjust the voltage going to the fan motor 14. When the air temperature falls below a predetermined level, the thermostat 24*b* will again communicate with the relay to adjust the fan motor 14 to a lower speed.

A second embodiment of the present invention comprises a two-piece hose system, wherein a first hose attaches to the intake port 10 of the housing. Said first hose has an open distal end. A proximate end of a second hose attaches to the distal end of said first hose. Said second hose has an open distal end and a plurality of holes within the wall of said second hose. This embodiment can be used to extend the length of the tubing extending from housing to the sleeping environment.

In another embodiment of the invention, a pad or mat is connected to the distal end of the tube as shown in FIGS. 5–8. The pad functions as the intake means in this embodiment. The pad of the present invention has an upper surface and a lower surface, and can vary in size. The pad may be sized to cover the mattress of various sizes of beds or may be dimensioned so that a person's body will fully fit on the pad when in a reclined position. It is also contemplated by the present invention that the pad be designed to fit on a sofa or chair for cooling the person while sitting or laying on these pieces of furniture. The upper surface of the pad faces a person and the lower surface of the pad contacts a the top surface of a mattress or mattress covering on a bed. The pad may also be placed on any other sleeping surface.

Figure 6:
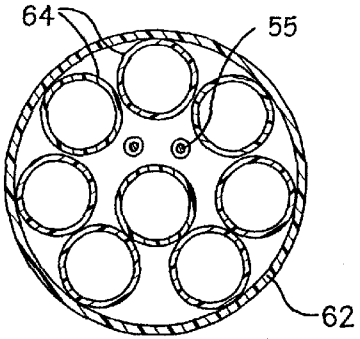
FIG. 6 illustrates a cross section of a conduit bundle in a second embodiment of the present invention.
Figure 7:
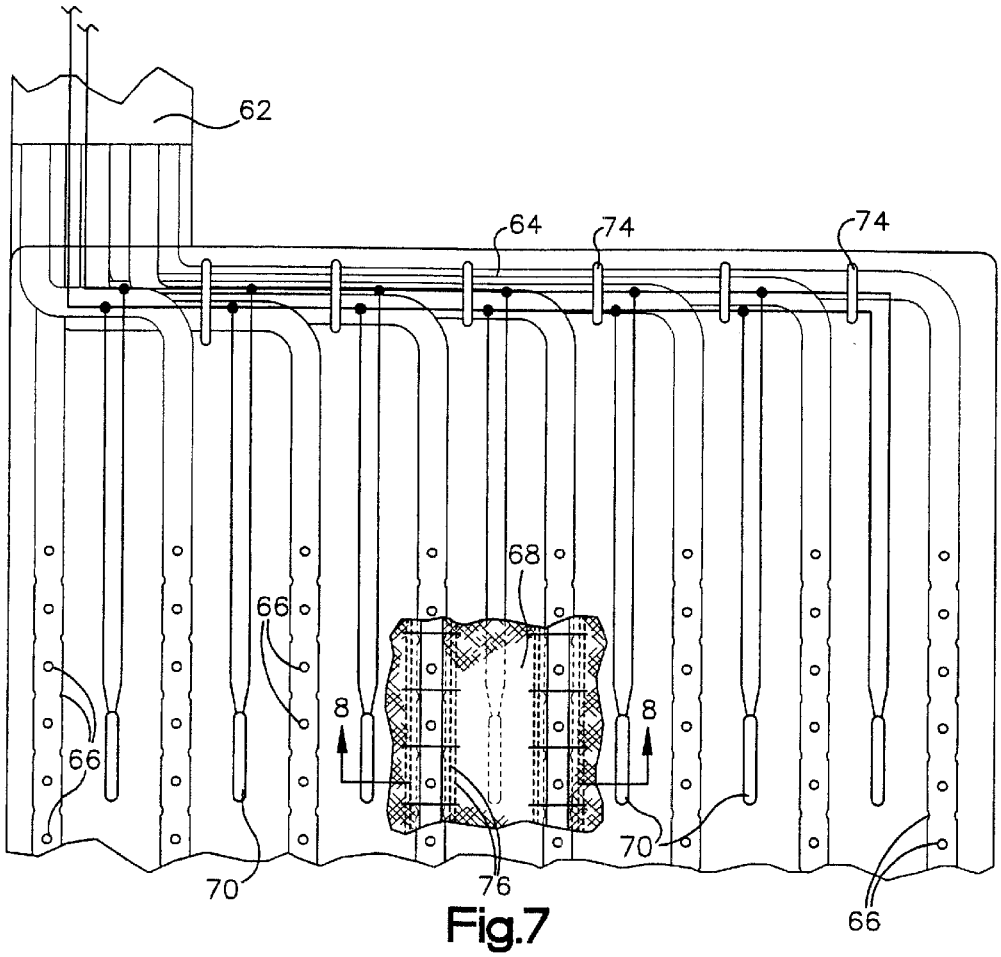
FIG. 7 illustrates an exploded view of the pad, conduits, thermister probes in accordance with the present invention.
Figure 8:
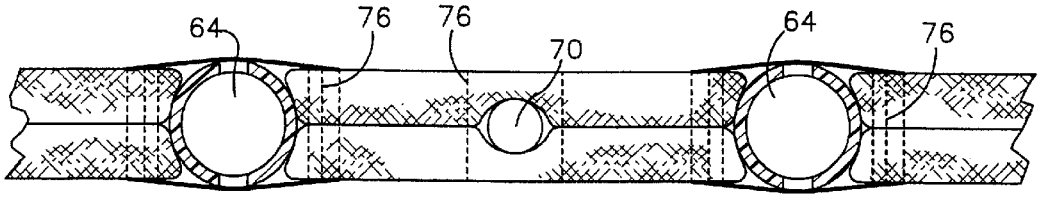
FIG. 8 illustrates the fabric layers surrounding the thermister probes and conduits in accordance with a second embodiment of the present invention.

The pad has air-circulatory conduits embedded therein 64. The conduits are comprised of a series of tubes 64 which are fluidly connected to an intake means 59 of a housing having a vacuum means as described in relation to FIG. 1, such as by a tube 62. The conduits have a plurality of holes 66 in their surfaces to draw air from the sleeping environment into the conduits 64. The distal end of said hose 62 can be permanently attached to said pad or removably attached to said pad. The tube connecting pad 68 to housing 50 may be of various lengths. The tube 62 may be comprised of a series of tubes removably connected to one another so that the total length of tube 62 may be varied depending on the needs of the user. The ends of the conduits are bundled 74 (FIGS. 6–7) at an end of the pad 68 and are connected to tube 62 to draw air into intake means 59. FIG. 6 shows a cross section of the conduit bundle. The conduits 64 are bundled together with ties or bands 74, or any other conventional means to hold together a bundle of tubes and/or wires.

A user of the present invention may want to experiment with the location where the tube 62 leaves the bed. Thus, the pad 68 may have openings on either surface for drawing air through pad. The conduits 64 have openings 66 on all sides in order to draw air despite the orientation of the pad. In addition, the pad may be configured to have multiple outlets for the tube to be connected to the pad. For instance, a square or rectangular pad may have an outlet for connecting the tube at each of the four corners of the pad. A circular pad may have tube outlets on opposite sides of a diameter of the pad. Such an arrangement will allow the user to control the orientation of the pad. In a preferred embodiment consisting of multiple outlets, a mechanism for closing off the outlets not currently in use will also be provided.

A thermister sensing temperature controller 54 (which may be referred to herein as just "thermister") is electrically attached 56 to the fan and may be situated either inside or outside the housing 53. The thermister sensing temperature controller 54 has a plurality of probes 70 that extend through the intake hose 62 and into the interior of the pad. The probes 70 are temperature sensitive. In this embodiment, the fan 52 draws air through holes 66 in conduits 64. This air flows over the thermister probes 70 in the pad. The thermister sensing temperature controller 54 monitors the temperature of the sleeping environment through the probes 70. The thermister probes are a more direct means of monitoring temperature, because the thermister probes are preferably capable of directly monitoring a person's body temperature through the pad. When the thermister probes sense a body temperature or a temperature of the air drawn into the pad that exceeds a predetermined limit set by dial 58, the thermister sensing temperature controller 54 communicates with its relay to adjust the speed of the fan based upon the detected temperature to draw more warm air away from the sleeping environment of the person. Similarly, when the thermister sensing temperature controller detects a decrease in the temperature of the sleeping environment, or when the temperature falls below a predetermined limit, the thermister sensing temperature controller communicates with its relay to decrease the speed of the fan.

In this embodiment, the thermister sensing temperature controller may adjust the voltage going to the fan motor to control the speed of the fan. However, other methods of controlling the fan speed are also contemplated such as using a transformer or having a fan with varying speeds which may be switched on and off.

The thermister probes 70 are stitched between two layers of fabric to hold them in place in the pad. A preferred fabric is artificial felt, however, any fabric that can be stitched around the thermister probes to securely hold them in place without substantially hindering their temperature sensing abilities may be used. In addition, the layers of fabric are stitched around the conduits inside the pad as well. It is preferred there should be a sufficient amount of holes 66 around the conduits 64 to effectively draw air away from the sleeping environment of the person. The conduits could be covered by a thin layer of fabric which allows air to be drawn through the fabric and into the conduits.

The cycle of increasing and decreasing the fan speed and thus, the amount of air drawn away from the sleeping environment of a person, helps to maintain a somewhat constant temperature of the sleeping environment.

The thermister sensing temperature controller and thermostat are both adjustable, whereby a person can set the preferred temperature of his or her sleeping environment. It should also be understood temperature gradients can be set for the thermostat or thermister devices. For instance, the lowest fan speed may be used to continuously draw air from the sleeping environment. The person using the device may set the thermostat to turn the fan to a higher speed at 70° F. and continue at that speed unless the temperature reaches 76° F., at which point the fan could switch to the next higher speed. Thus, the fan speed could fluctuate between the three or more fan speeds throughout the night to maintain a consistent temperature in the sleep environment.

The present invention also includes a method of treating sleep apnea using the embodiments of the device as described above. In the first embodiment, a person who suffers from sleep apnea positions the distal end of the intake tube under between the mattress and a sheet and/or blanket used to cover the person while sleeping. Or, the person can attach an intake tube to a pad for use in the present invention. The individual may hold the end of the intake tube under his or her arm or leg or fasten the tube under the blankets so that it stays in place. Alternatively, the person may lie on a pad which is connected to the intake tube. In the pad embodiment, it is preferred that the person be covered with a sheet or blanket but it is not required. As the person sleeps, thermister probes in the pad sense the temperature of the sleeping environment then the thermister sensing temperature controller monitors an air temperature which is equal to or exceeds a predetermined temperature at which the person is likely to suffer from sleep apnea, then electrically communicates with the fan motor to increase the fan speed and thus draw more air from the person's sleeping environment. When the thermostat or thermister sensing temperature controller senses that the sleeping environment has cooled to a predetermined temperature, the thermister sensing temperature controller electrically communicates with the fan motor to decrease the fan speed again.

It should be understood that the present invention is not limited to the embodiments herein shown and described. Variations on these embodiments are contemplated by the present invention and covered by the claims.

What is claimed is:

1. A device for controlling a temperature of a person's sleeping environment, comprising:

means for drawing a vacuum to draw air from a sleeping environment;

means for fluidly connecting said sleeping environment to an intake port of said vacuum means;

means for determining a temperature of said air drawn from said sleeping environment; and means for adjusting the speed of said air being drawn out of said sleeping environment based upon said temperature of said air.

2. The device as described in claim 1, wherein said means for drawing a vacuum comprises:

a housing comprising said intake port and an exhaust port; and a fan having an electric motor, said fan positioned within said housing so that said fan draws air into said housing through said intake port and expels air through said exhaust port.

3. The device as described in claim 2 wherein said electric fan motor is capable of operating at at least two speeds.

4. The device as described in claim 2, wherein said means for fluidly connecting said sleeping environment to said intake port comprises:

a hose, said hose having an open distal end and an open proximate end, wherein said open proximate end is connected to said intake port and said open distal end is positioned within said sleeping environment.

5. The device as described in claim 4, wherein said hose has a plurality of holes in a wall of said hose; said holes extending a length substantially equal to a length of said hose positioned within said sleeping environment.

6. The device as described claim 1, wherein said means for fluidly connecting said sleeping environment to said intake port comprises:

a pad, said pad comprising a plurality of air circulatory conduits positioned within said pad, said air circulatory conduits having at least one hole in a surface thereof;

a hose connecting said air circulatory conduits to said intake port; and wherein said pad is positioned beneath a person's body in said sleeping environment.

7. The device as described in claim 1, wherein said means for determining a temperature of said air drawn from said sleeping environment comprises:

a thermister sensing temperature controller, said thermister sensing temperature controller electrically connected to said electric fan motor.

8. The device as described in claim 7, further comprising:

at least one thermister probe positioned within said pad, said thermister probe electrically connected to said thermister sensing temperature controller.

9. The device as described in claim 8, wherein said thermister sensing temperature controller is programmable such that when said thermister probe reads a predetermined temperature of said sleeping environment, said thermister sensing temperature controller communicates with said electric fan motor to increase or decrease said fan speed.

10. The device as described in claim 1, wherein said means for determining said temperature of said air drawn from said sleeping environment comprises a thermostat.

11. The device as described in claim 6, wherein said means for drawing a vacuum comprises:

a housing comprising said intake port and an exhaust port; and an fan having an electric motor, said fan positioned within said housing so that said fan draws air into said housing through said intake port and expels air through said exhaust port.

12. The device as described in claim 11, wherein said electric fan motor is capable of operating at at least two speeds.

13. The device as described in claim 10, wherein said thermostat is electrically connected to said electric fan motor.

14. The device as described in claim 13, wherein said thermostat is programmable to communicate with said electric fan motor when said thermostat reads a predetermined temperature of said air to increase or decrease a speed of said fan motor.

15. A device for controlling the temperature of a person's sleeping environment comprising:

a housing comprising an intake port and an exhaust port;

an electric fan positioned within said housing so that said fan draws air into said housing through said intake port and expels air through said exhaust port;

a hose, fluidly connecting said intake port to a person's sleeping environment;

a thermostat positioned within said housing, said thermostat electrically connected to said electric fan.

16. The device as recited in claim 15, wherein said housing comprises:

a first chamber wherein said fan is positioned; and a second chamber wherein said thermostat is positioned.

17. The device as described in claim 6 further comprising:

a plurality of openings in a surface of said pad, said openings corresponding to said hole in said surface of said air circulatory conduits.

18. The device as described in claim 4 wherein said sleeping environment comprises an area between a surface upon which a person is sleeping and a cover positioned over said surface and said person.

19. A method of treating sleep apnea comprising the steps of:

providing a means for drawing air from beneath a cover on a bed;

providing a means to determine the temperature of said air;

adjusting an amount of air drawn from beneath said cover based on said temperature of said air.

20. The method as recited in claim 19 wherein said means for drawing air from beneath a cover on a bed comprises:

a housing comprising an intake port and an exhaust port;

a fan having an electric motor positioned within said housing; and a tube, wherein a first end of said tube is connected to said intake port and a second end of said tube is positioned beneath said cover on said bed.

21. The method as recited in claim 20 wherein said fan draws air from said sleeping environment through said first end of said tube into said housing and expels said air through said exhaust port.

22. The method as recited in claim 19 wherein said means for drawing air from beneath a cover on a bed comprises:

a housing comprising an intake port and an exhaust port;

a fan having an electric motor positioned within said housing;

a pad having air conduits therein, wherein said pad is positioned beneath a person's body in said sleeping environment; and a tube connecting said air conduits in said pad to said intake port of said housing.

23. The method as recited in claim 22 wherein said fan draws air through said air conduits, through said tube into said housing and expels said air through said exhaust port.

* * * * *